US012736045B2

(12) United States Patent
Belshan et al.

(10) Patent No.: US 12,736,045 B2
(45) Date of Patent: Sep. 15, 2026

(54) CONTROLLING SUCTION VALVES OF A FLUID PUMP

(71) Applicant: SPM Oil & Gas Inc., Fort Worth, TX (US)

(72) Inventors: Daryl Belshan, Weatherford, TX (US); Wesley P. Clark, Weatherford, TX (US); Ralph Harris, Fort Worth, TX (US); Chandu Kumar, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 41 days.

(21) Appl. No.: 18/742,666

(22) Filed: Jun. 13, 2024

(65) Prior Publication Data

US 2025/0382956 A1 Dec. 18, 2025

(51) Int. Cl.

| | |
|---|---|
| ***F04B 49/24*** | (2006.01) |
| ***F04B 17/05*** | (2006.01) |
| ***F04B 19/22*** | (2006.01) |
| ***F04B 49/22*** | (2006.01) |

(52) U.S. Cl.

CPC ..... *F04B 49/243* (2013.01); *F04B 17/05* (2013.01); *F04B 19/22* (2013.01); *F04B 49/22* (2013.01)

(58) Field of Classification Search

CPC ..... F04B 19/22; F04B 49/22; F04B 49/243; F04B 1/053; F04B 9/045; F04B 15/02; F04B 17/05; F04B 23/06; F04B 49/03–035; E21B 34/14; E21B 43/126; E21B 43/26; E21B 47/008

See application file for complete search history.

(56) References Cited

U.S. PATENT DOCUMENTS

| | | | | |
|---|---|---|---|---|
| 8,506,262 | B2 * | 8/2013 | Leugemors | F04B 53/1022 417/311 |
| 11,125,225 | B2 | 9/2021 | Beisel | |
| 11,697,985 | B2 | 7/2023 | Zhang et al. | |
| 11,702,920 | B1 | 7/2023 | Mao et al. | |
| 11,753,911 | B1 | 9/2023 | Kabrich et al. | |
| 2008/0279705 | A1 | 11/2008 | Wago et al. | |
| 2009/0041588 | A1 * | 2/2009 | Hunter | F04B 7/0076 417/27 |
| 2010/0183448 | A1 * | 7/2010 | Leugemors | F04B 49/22 417/53 |
| 2020/0256333 | A1 * | 8/2020 | Surjaatmadja | F04B 49/03 |
| 2020/0277951 | A1 * | 9/2020 | Hunter | F04B 17/05 |
| 2023/0145747 | A1 * | 5/2023 | Harris | F04B 53/10 417/510 |

FOREIGN PATENT DOCUMENTS

| | | |
|---|---|---|
| CA | 2686773 C | 11/2008 |

* cited by examiner

*Primary Examiner* — Alexander B Comley

(57) ABSTRACT

A controller may monitor an operating parameter relating to at least one of a fluid pump or a prime mover for the fluid pump. The fluid pump may be configured to discharge fluid during a plurality of discharge cycles. The fluid pump may have a suction valve configured to close during the plurality of discharge cycles. The controller may cause, responsive to the operating parameter indicating that the fluid pump is to be deactivated, the suction valve to be maintained in an open position throughout one or more discharge cycles of the plurality of discharge cycles.

20 Claims, 5 Drawing Sheets

CONTROLLING SUCTION VALVES OF A FLUID PUMP

TECHNICAL FIELD

The present disclosure relates generally to fluid pumps and, for example, to controlling suction valves of a fluid pump.

BACKGROUND

Large pumps are commonly used in oil and gas extraction applications. For example, a high-pressure reciprocating pump may be suitable for uses relating to hydraulic fracturing, well cementing, or well drilling. These large pumps may use poppet-style valves that open and close by differential pressure across the valves. The valves allow flow of a fluid into a fluid chamber to be compressed, and flow out from the fluid chamber when an internal pressure exceeds a working discharge pressure. A reciprocating pump may be driven by a prime mover, such as an engine. During operation of a pump, conditions may occur (e.g., an overpressure event or a sand off event) that calls for the rapid termination of discharge flow from the fluid pump. However, the prime mover may take a relatively long time to slow down, thereby frustrating an attempt to rapidly terminate discharge flow from the fluid pump, which may lead to damage to the pump or other equipment, as well as other adverse consequences.

SUMMARY

A suction valve control system of a fluid pump that is configured to discharge fluid during a plurality of discharge cycles may include a suction valve, of the fluid pump, that is configured to close during the plurality of discharge cycles. The suction valve control system may include a controller configured to cause, responsive to a pump deactivating event, the suction valve to be maintained in an open position throughout one or more discharge cycles of the plurality of discharge cycles, where the open position corresponds to an opening of the suction valve during a plurality of suction cycles of the fluid pump.

A method may include monitoring, by a controller, an operating parameter relating to at least one of a fluid pump or a prime mover for the fluid pump. The fluid pump is configured to discharge fluid during a plurality of discharge cycles. The fluid pump may have a suction valve configured to close during the plurality of discharge cycles. The method may include causing, by the controller and responsive to the operating parameter indicating that the fluid pump is to be deactivated, the suction valve to be maintained in an open position throughout one or more discharge cycles of the plurality of discharge cycles.

A fluid pump system may include a fluid pump that includes a fluid end having a fluid chamber, a plunger configured to reciprocate with respect to the fluid chamber, and a suction valve biased to a closed position with respect to the fluid chamber; and a power end, operably connected to the plunger, configured to be driven by a prime mover. The fluid pump system may include a suction valve control system that includes a valve control component configured to control actuation of the suction valve, and a controller communicatively coupled to the valve control component. The controller may be configured to cause the valve control component to maintain the suction valve in an open position throughout one or more discharge cycles of the fluid pump to cause termination of discharge flow from the fluid pump.

DETAILED DESCRIPTION

This disclosure relates to a suction valve control system, which is applicable to any fluid pump that employs a suction valve configured to open by differential pressure of fluid. For example, the fluid pump may be a positive displacement pump, such as a reciprocating pump.

Figure 1:
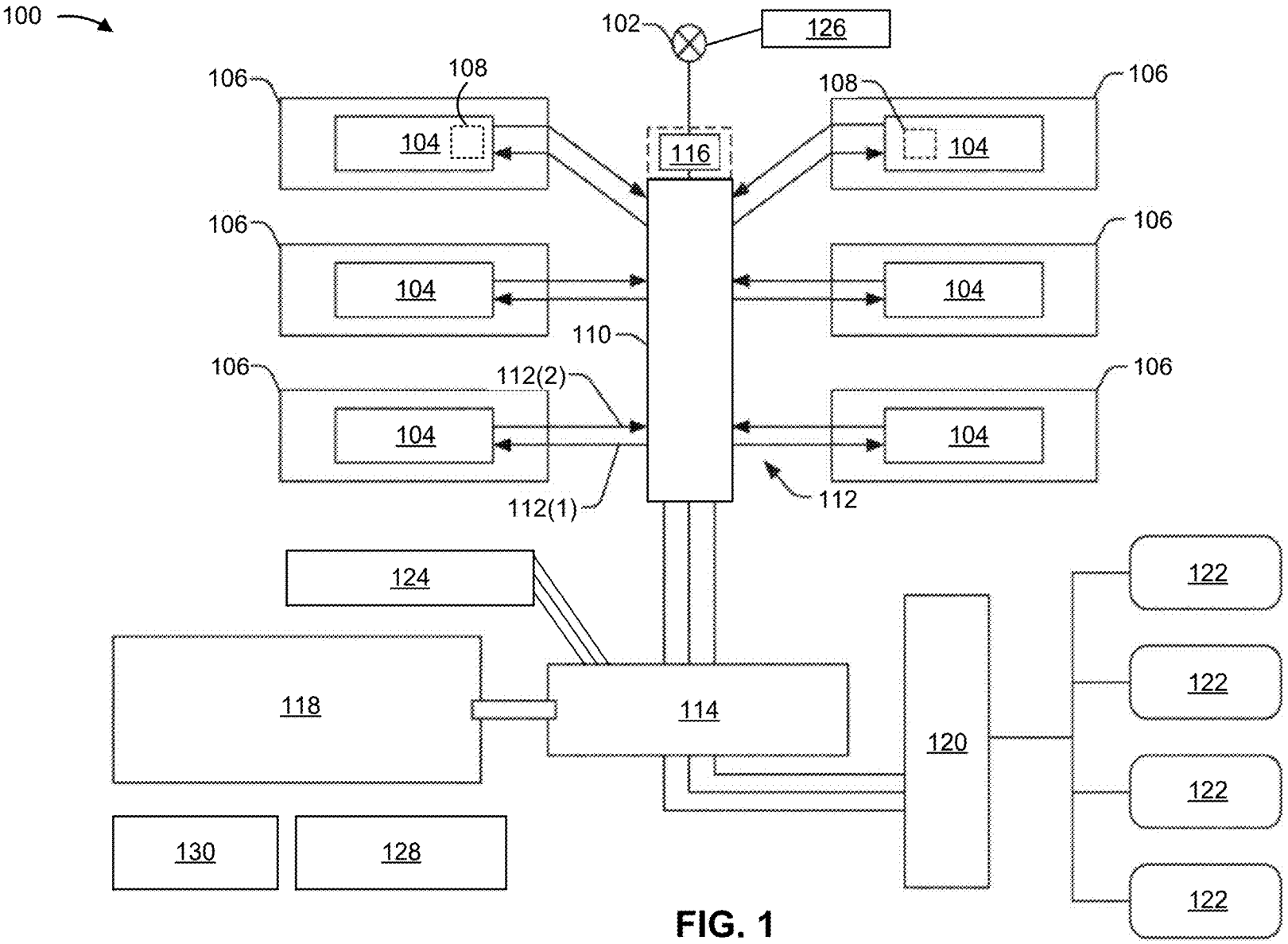
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid, which may be received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120, or alternatively a chemical adding unit or the blender 114, may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100.

As indicated above, FIG. 1 is provided as an example. Other examples may differ from what is described with regard to FIG. 1.

Figure 2A:
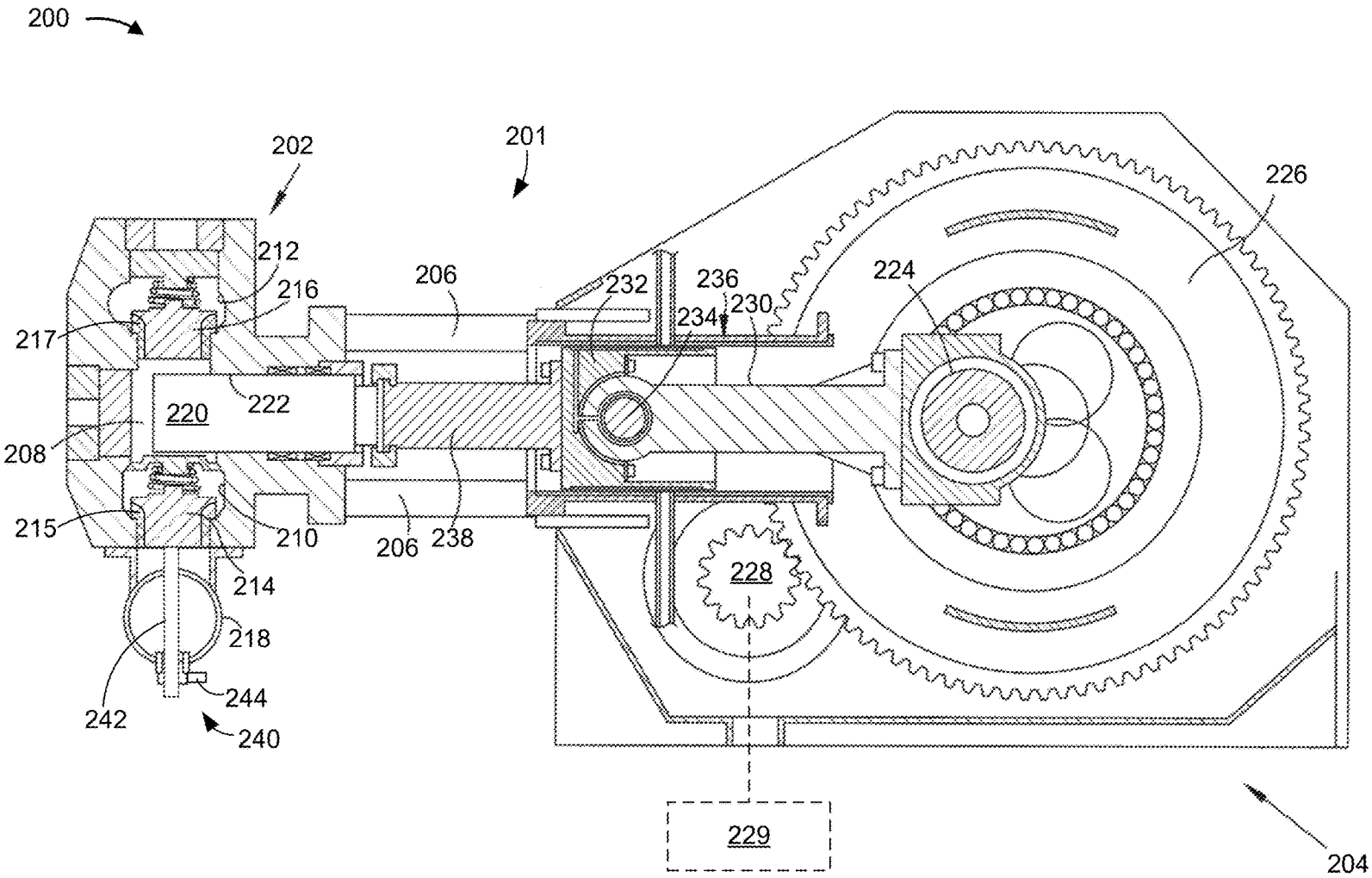
FIGS. 2A-2B are diagrams illustrating a sectional view of an example fluid pump system.
Figure 2B:
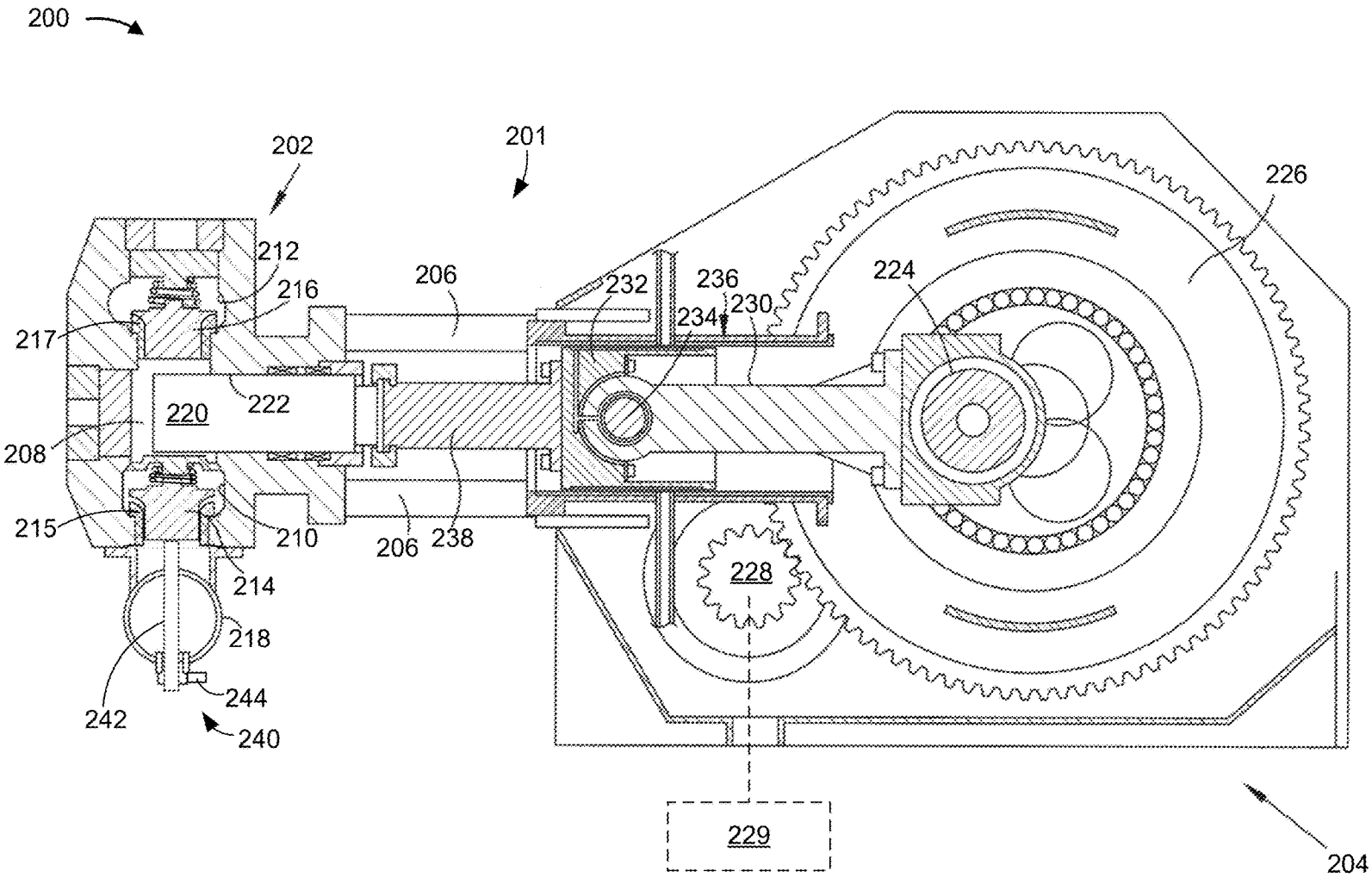

FIGS. 2A-2B are diagrams illustrating a sectional view of an example fluid pump system 200. The fluid pump system 200 includes a fluid pump 201 (e.g., a fluid pump assembly) and a suction valve control system 240. The fluid pump 201 may be configured to operate in an application relating to oil and gas extraction, such as hydraulic fracturing, well cementing, and/or well drilling, among other examples. In some implementations, the fluid pump 201 may be mounted on a trailer to facilitate transportation of the fluid pump 201 between operational sites. The fluid pump 201 may be a positive displacement pump. For example, the fluid pump 201 may be a reciprocating pump, as shown.

In some implementations, the fluid pump 201 may have a capability to produce a maximum discharge pressure of at least 10,000 psi, at least 15,000 psi, or at least 20,000 psi. For example, the fluid pump 201 may be a hydraulic fracturing pump (e.g., the fluid pump 201 may correspond to the fluid pump 108). In some implementations, the fluid pump 201 may have a capability to produce a maximum discharge pressure of at most 7,500 psi, at most 5,000 psi, or at most 1,000 psi. For example, the fluid pump 201 may be a cement pump (e.g., configured to pump cement), a mud pump (e.g., configured to pump drilling fluid, also known as "drilling mud"), and/or an injection pump (e.g., configured to pump water and/or chemicals for injection to a well), among other examples.

The fluid pump 201 includes a fluid end 202 and a power end 204. The fluid end 202 may be connected to the power end 204 by stay rods 206. The fluid end 202 includes one or more fluid chambers 208 (only one shown). For example, the fluid pump 201 may include one, two, three, four, five, or more fluid chambers 208 and associated components. A fluid chamber 208 may sometimes be referred to as a "bore" of the fluid pump 201.

The fluid pump 201 may be configured to allow fluid to flow into the fluid chamber 208 during suction cycles of the fluid pump 201, and to discharge fluid during discharge cycles of the fluid pump 201. The fluid pump 201 includes a suction valve 214, disposed within a suction bore 210, that is configured to control fluid suction into the fluid chamber 208. The suction valve 214 (e.g., a poppet-style valve) may be biased (e.g., by a spring) to a closed position with respect to a suction valve seat 215 (thereby creating a seal) in the fluid chamber 208. For example, the suction valve 214 may be configured to close during discharge cycles of the fluid pump 201. Similarly, the fluid pump 201 includes a discharge valve 216, disposed within a discharge bore 212, that is configured to control fluid discharge from the fluid chamber 208. The discharge valve 216 (e.g., a poppet-style valve) may be biased (e.g., by a spring) to a closed position with respect to a discharge valve seat 217 (thereby creating a seal) in the fluid chamber 208. During a suction stroke of a plunger 220, fluid is allowed to flow from a suction manifold 218 through the suction valve 214 and into the fluid chamber 208. The fluid is then pumped in response to a discharge stroke (e.g., a forward stroke) of the plunger 220 and flows through the discharge valve 216 into the discharge bore 212. The discharge bore 212 may be fluidly coupled to a wellbore or other destination to supply high pressure fluid.

In operation, the reciprocating plunger 220 moves in a plunger bore 222 and is driven by the power end 204 of the fluid pump 201. The power end 204 may include a crankshaft 224 that is rotated by a gearbox output 226 (illustrated by a single gear, but may be more than one gear). A gearbox input 228 may be coupled to a transmission (not shown) and/or a prime mover 229 to rotate the gearbox input 228 during operation. In some implementations, the gearbox input 228 may be coupled directly to the prime mover 229 without use of a transmission. For example, the suction valve control system 240 described herein enables variable pump displacement, thereby allowing the power end 204 to be driven by the prime mover 229 without use of a transmission (although a transmission may be used in some configurations).

As one example, the prime mover 229 may include a reciprocating engine, which may be configured to drive the power end 204 without use of a transmission. As another example, the prime mover 229 may include a gas engine (also referred to as a "natural gas engine" or a "gaseous fuel engine"), which may be configured to operate at constant speed. As an additional example, the prime mover 229 may include a turbine engine, such as a single-shaft turbine engine or a dual-shaft turbine engine. In some implementations, the prime mover 229 may include an electric motor, such as a direct current (DC) electric motor or an alternating current (AC) electric motor. The electric motor may be configured to drive the power end 204 with or without control by a variable frequency drive (e.g., at constant speed). As a further example, the prime mover 229 may include a diesel engine, which may be configured to drive the power end 204 using a transmission.

A connecting rod 230 mechanically connects the crankshaft 224 to a crosshead 232 via a wrist pin 234. The crosshead 232 is mounted within a stationary crosshead housing 236, which constrains the crosshead 232 to linear reciprocating movement. A pony rod 238 connects to the crosshead 232 and has its opposite end connected to the plunger 220 to enable reciprocating movement of the plunger 220 (e.g., the plunger 220 is operably connected to the power end 204). The plunger 220 may be one of a plurality of plungers, such as, for example, three or five plungers, depending on the size of the fluid pump 201 (e.g., three cylinder, five cylinder, etc.) and the number of fluid chambers 208.

The plunger 220 extends through the plunger bore 222 so as to interface and otherwise extend within the fluid chamber 208. In operation, movement of the crankshaft 224 causes the plunger 220 to reciprocate within, or move linearly toward and away from, the fluid chamber 208. As the plunger 220 translates away from the fluid chamber 208 (a suction stroke of the plunger 220), the pressure of the fluid inside the fluid chamber 208 decreases, which creates a pressure differential across the suction valve 214. The pressure differential across the suction valve 214 enables actuation (e.g., opening) of the suction valve 214 to allow the fluid to enter the fluid chamber 208 from the suction manifold 218 (e.g., the fluid is pressurized to a low pressure, such as from 60 to 100 psi, by an outside system, such as a centrifugal pump, and pushed through the suction manifold 218). The pumped fluid is pushed into the fluid chamber 208 as the plunger 220 continues to translate away from the fluid chamber 208. As the plunger 220 changes directions and moves toward the fluid chamber 208 (a discharge stroke of the plunger 220), the fluid pressure inside the fluid chamber 208 increases, which creates a pressure differential across the discharge valve 216. Fluid pressure inside the fluid chamber 208 continues to increase as the plunger 220 approaches the fluid chamber 208 until the pressure differential across the discharge valve 216 is great enough to actuate (e.g., open) the discharge valve 216 and enable the fluid to exit the fluid chamber 208.

As an example, at top dead center (TDC) of the plunger 220 (when the plunger 220 is furthest from the crankshaft 224 center line, and volume in the fluid chamber 208 is at a minimum), pressure in the fluid chamber 208 is at, or is close to, a discharge pressure of the fluid pump 201. As the plunger 220 moves away from TDC, both the discharge valve 216 and the suction valve 214 may be closed, and pressure drops as volume in the fluid chamber 208 increases. The relationship between pressure and volume when the discharge valve 216 and the suction valve 214 are closed is defined largely by the compressibility of a fluid being pumped. When the pressure in the fluid chamber 208 is near, or is below, a suction pressure, the suction valve 214 opens, and flow begins to enter the fluid chamber 208 (e.g., while the plunger 220 is still moving away from TDC). The rate of flow into the fluid chamber 208 is controlled by the speed of the plunger 220. At about 80 degrees from TDC, when the crankshaft 224 is at 90 degrees to the centerline of the connecting rod 230, plunger velocity and suction flow rate is at a maximum. As the plunger 220 moves toward bottom dead center (BDC) of the plunger 220 (volume in the fluid chamber 208 is at a maximum), the plunger velocity and suction valve flow rate approaches zero. The suction valve 214 may close at this point, or slightly after when the plunger 220 begins to travel back towards TDC. As the plunger 220 moves toward TDC, both the suction valve 214 and the discharge valve 216 may be closed, and pressure increases in the fluid chamber 208 as volume is decreased. The discharge valve 216 opens when the pressure in the fluid chamber 208 is at, or slightly exceeds, the discharge pressure of the discharge bore 212. Flow may leave the fluid chamber 208 during the period when the discharge valve 216 opens and then closes, near or slightly after when the plunger 220 is back at TDC.

The suction valve control system 240 may include one or more valve control components 242 and a controller 244. A valve control component 242 is configured to control actuation of a suction valve 214, which may include controlling closing of the suction valve 214, controlling opening of the suction valve 214, and/or controlling lift (e.g., a maximum lift) of the suction valve 214. For example, the valve control component 242 is configured to restrict ordinary closing (e.g., ordinary closing due to a biasing member and/or pressurization of the fluid chamber 208) of the suction valve 214 in a controlled manner (e.g., the valve control component 242 may be configured to hold open the suction valve 214 and to release the suction valve 214 according to a desired timing). In one example, the valve control component 242 may include an actuator (e.g., a plunger-type actuator) that is hydraulically controlled (e.g., by a solenoid valve), or electronically and/or mechanically controlled. The actuator may be configured to actuate between a retracted position and an extended position, and, in some examples, to intermediate positions between the retracted position and the extended position. The actuator may be positioned such that in an extended position, the actuator can reach the underside of the suction valve 214 (e.g., the side of the suction valve 214 opposite the fluid chamber 208) when the suction valve 214 is in an open position. Alternatively, the actuator may be attached to the suction valve 214. In some examples, the valve control component 242 may include a physical part that is configured to directly contact a surface of the suction valve 214 in order to hold open the suction valve 214. The valve control component 242 is not limited to any particular type of actuator, physical part, and/or actuation mechanism described herein. The suction valve control system 240 may include a respective valve control component 242 for each suction valve 214 of the fluid pump 201. Phase between the valve control components 242 and the plunger 220 may be established from a timing wheel or a phase marker on the fluid pump 201, which can be correlated to control signals for the valve control components 242.

In FIG. 2A, the valve control component 242 is shown not holding open the suction valve 214, and the suction valve 214 is in a closed position. In FIG. 2B, the valve control component 242 is shown holding the suction valve 214 in an open position.

The controller 244 may include one or more memories and one or more processors communicatively coupled to the one or more memories. A processor may include a central processing unit, a graphics processing unit, a microprocessor, a controller, a microcontroller, a digital signal processor, a field-programmable gate array, an application-specific integrated circuit, and/or another type of processing component. The processor may be implemented in hardware, firmware, or a combination of hardware and software. The processor may be capable of being programmed to perform one or more operations or processes described elsewhere herein. A memory may include volatile and/or nonvolatile memory. For example, the memory may include random access memory (RAM), read only memory (ROM), a hard disk drive, and/or another type of memory (e.g., a flash memory, a magnetic memory, and/or an optical memory). The memory may be a non-transitory computer-readable medium. The memory may store information, one or more instructions, and/or software (e.g., one or more software applications) related to the operation of the controller 244.

The controller 244 may be mounted on the fluid pump 201, the fluid end 202, the suction manifold 218, another component of the fluid pump system 200, or the prime mover 229. Alternatively, the controller 244 may be remote from the fluid pump 201 or the prime mover 229. The controller 244 is communicatively coupled to the valve control components 242. The controller 244 may control a timing at which the valve control components 242 restrict closing of the suction valves 214 (e.g., the controller 244 may control a timing of actuation of the actuators controlling the suction valves 214). Operations described herein as being performed by the controller 244 may be performed by (e.g., split among) multiple controllers (e.g., a first controller may determine the timing and provide instructions to an additional controller that controls the valve control components 242).

The controller 244 may be communicatively coupled to one or more sensors on the fluid pump 201 (e.g., a pressure sensor or a flow rate sensor, among other examples) and/or communicatively coupled to one or more additional controllers associated with the fluid pump 201 and/or the prime mover 229. Thus, the controller 244 may receive input data from the sensor(s) and/or the additional controller(s), and the controller 244 may control a timing of the valve control components 242 (e.g., individually or in unison) in accordance with the input data. The input data may relate to various operating parameters relating to the fluid pump 201 and/or the prime mover 229.

For example, the input data may indicate a type of prime mover, a prime mover output speed, a prime mover available torque, a prime mover actual torque, a prime mover quick to neutral indication (e.g., an indication that the prime mover 229 should be immediately relieved of all output load), a transmission output speed, a transmission output torque, a transmission quick to neutral indication (e.g., an indication that the transmission should be immediately put in neutral), a pump crankshaft speed, a pump crankshaft angle, a pump plunger(s) location, a power end vibration, a fluid end vibration, a pump discharge pressure, a pump required input torque, a pump suction pressure, a pump lube oil pressure, a pump lube oil temperature, a fluid end valve leak detection indication, a fluid end packing leak detection indication, a desired pump flow indicated using an input device or determined automatically (e.g., using a machine learning model), a pump output torque, a pump flow, a quantity of pump plungers, a plunger size (e.g., a configured variable), a pump stroke (e.g., a configured variable), a pump rod load (e.g., calculated from plunger size and discharge pressure), and/or a pump displacement (e.g., calculated from pump stroke, plunger size, and quantity of plungers), among other examples. In some examples, the input data may include available torque of the prime mover and pump required input torque, and the suction valve control system 240 is configured to maintain (e.g., constantly, at least during a certain portion of operation such as start-up) pump required input torque at or below available torque of the prime mover 229. In some examples, the input data may include pump discharge pressure and pump flow, and the suction valve control system 240 is configured to determine pump required input torque based on pump discharge pressure and pump flow. In some examples, the input data may include pump discharge pressure and pump crankshaft speed, and the suction valve control system 240 is configured to determine pump required input torque based on pump discharge pressure and pump crankshaft speed. In some examples, the input data may include pump output torque and pump flow, and the suction valve control system 240 is configured to determine pump required input torque based on pump output torque and pump flow. In some examples, the input data may include pump output torque and pump crankshaft speed, and the suction valve control system 240 is configured to determine pump required input torque based on pump output torque and pump crankshaft speed. The exemplary input data described above, provided to the suction valve control system 240, can enable balancing of pump required input torque with available torque of the prime mover that solves one or more of the problems set forth herein and/or other problems in the art.

As indicated above, FIGS. 2A-2B are provided as an example. Other examples may differ from what is described with regard to FIGS. 2A-2B.

Figure 3:
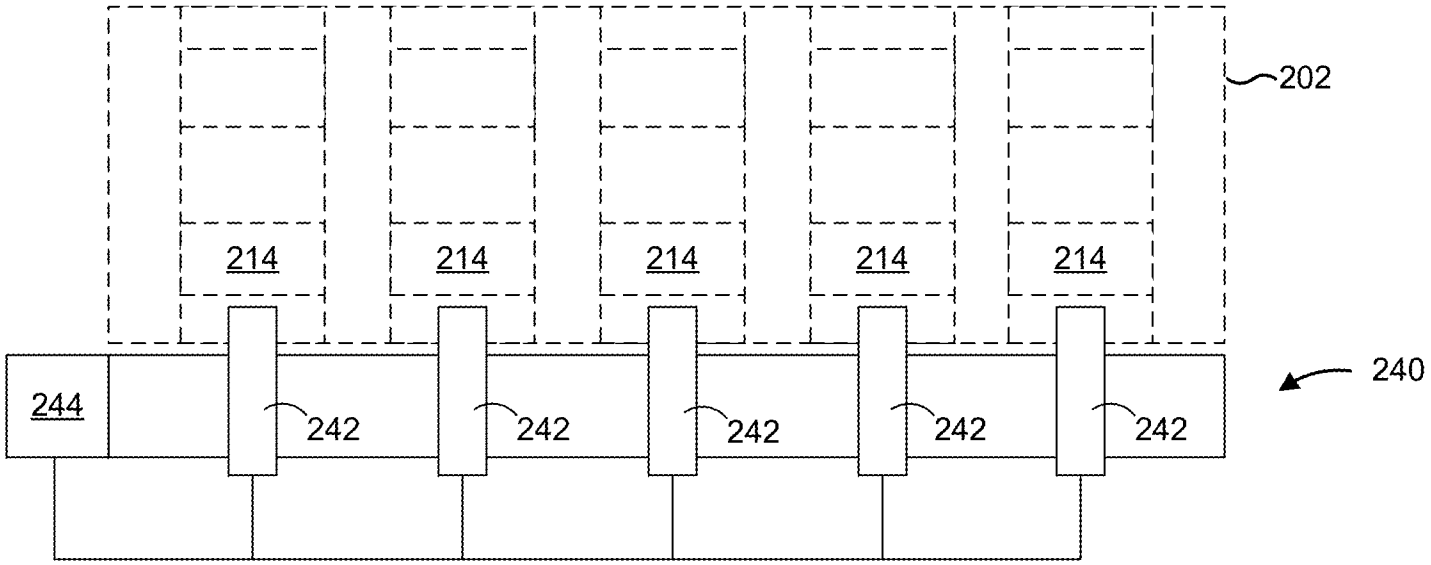
FIG. 3 is a diagram illustrating an example of the suction valve control system.

FIG. 3 is a diagram illustrating an example of the suction valve control system 240. As shown in FIG. 3, and described herein, the suction valve control system 240 may include a plurality of valve control components 242 and the controller 244. The suction valve control system 240 is shown with five valve control components 242, each to control a respective suction valve 214 of the fluid end 202. However, the suction valve control system 240 may include a different quantity of valve control components 242, depending on a quantity of suction valves 214 (corresponding to a quantity of fluid chambers 208) of the fluid end 202.

The controller 244 is configured to perform operations relating to control of the valve control components 242 to provide variable displacement of the fluid pump 201. The controller 244 may perform the operations to achieve rapid deactivation of the fluid pump and/or rapid unloading of the prime mover 229 for the fluid pump 201. For example, slowing down the prime mover 229 may take an excessive amount of time, thereby preventing rapid termination of discharge flow from the fluid pump.

The controller 244 may monitor one or more operating parameters relating to the prime mover 229 and/or the fluid pump 201. For example, the controller 244 may receive an indication of the operating parameters from an additional controller of the prime mover 229. Additionally, or alternatively, the controller 244 may obtain data relating to the operating parameters from one or more sensors on the fluid pump 201. The operating parameters may include a torque (e.g., an actual torque) of the prime mover 229, an output speed of the prime mover 229, a flow rate of the fluid pump 201, and/or a discharge pressure of the fluid pump 201, among other examples (e.g., including any of the input data to the controller 244 described herein). The controller 244 may monitor the operating parameters to detect a pump deactivating event, which is an event when the fluid pump 201 should be deactivated (e.g., to avoid an unsafe condition, to prevent damage, or the like), as described herein. "Deactivation" of the fluid pump 201 may refer to stopping discharge flow from the fluid pump 201.

Prior to the pump deactivating event, the controller 244 may cause, during one or more discharge cycles of the fluid pump 201, one or more suction valves 214 (e.g., all of the suction valves 214) not to be maintained in the open position during any portion of the discharge cycles. For example, the controller 244 may deactivate one or more valve control components 242 (e.g., all of the valve control components 242) to cause the suction valves 214 not to be maintained in the open position. Causing the suction valves 214 not to be maintained in the open position may include allowing unrestricted operation of the suction valves 214 (e.g., the suction valves 214 may be allowed to open and close normally due to a biasing member and/or pressure differential).

Thereafter, the controller 244 may detect a pump deactivating event. In some implementations, based on monitoring the operating parameters, the controller 244 may detect that an operating parameter (e.g., a measurement relating to the operating parameter) indicates that the fluid pump 201 is to be deactivated (e.g., due to the operating parameter being at an unsafe level, at a level that could cause damage, or the like), where the pump deactivating event may be detecting that the operating parameter indicates that the fluid pump 201 is to be deactivated. For example, the controller 244 may detect that the operating parameter satisfies a threshold, where the pump deactivating event may be detecting that the operating parameter satisfies the threshold (e.g., the operating parameter satisfying the threshold may indicate that the fluid pump 201 is to be deactivated). The operating parameter may be a discharge pressure of the fluid pump 201, a flow rate of the fluid pump 201, a torque of the prime mover 229, and/or a speed (e.g., an output speed) of the prime mover 229, among other examples. As an example, the pump deactivating event may be the discharge pressure of the fluid pump 201 satisfying a pressure threshold, a difference between the discharge pressure of the fluid pump 201 and a commanded pressure satisfying a pressure difference threshold, a flow rate of the fluid pump satisfying a flow rate threshold, a difference between the flow rate of the fluid pump 201 and a commanded flow rate satisfying a flow rate difference threshold, a torque of the prime mover 229 satisfying a torque threshold, and/or a speed (e.g., an output speed) of the prime mover 229 satisfying a speed threshold, among other examples. Any of the aforementioned thresholds may be a static value, or may be a dynamic value that changes with changes to one or more of the operating parameters.

In some implementations, the controller 244 may receive an indication, based on a user input, that the fluid pump 201 is to be deactivated, where the pump deactivating event may be receiving the indication. The user input may be made via a button, a touchscreen display, a remote control device, or the like. For example, the user input may cause the indication (e.g., a deactivation signal) to be sent to, or to be generated by, the controller 244.

Responsive to the pump deactivating event, the controller 244 may cause, such as by using one or more of the valve control components 242 (e.g., all of the valve control components 242), one or more suction valves 214 to be maintained in their open positions (e.g., the suction valves 214 are held open) during one or more discharge cycles of the fluid pump 201 (e.g., throughout each discharge cycle). These discharge cycles may include start-up discharge cycles of the fluid pump 201, which occur during a start-up period of the fluid pump 201 (e.g., after the prime mover 229 is activated from a stationary state and including at least an earliest discharge cycle after the prime mover 229 is activated from the stationary state), and/or may include steady state discharge cycles of the fluid pump 201, which occur after the start-up period. The controller 244 may cause the suction valves 214 to be maintained in their open positions while the prime mover 229 is in a non-stationary state. Moreover, causing the suction valves 214 to be maintained in their open positions may cause termination of discharge flow from the fluid pump 201 (e.g., without waiting for the prime mover 229 to slow down). Furthermore, the controller 244 may cause the suction valves 214 to be maintained in their open positions until the prime mover 229 is in a stationary state (e.g., based on a speed measurement indicated from an additional controller of the prime mover 229 to the controller 244). An open position of a suction valve 214 may correspond to an opening of the suction valve 214 during suction cycles (e.g., steady state suction cycles) of the fluid pump 201. For example, an open position of a suction valve 214 may be a full open position that corresponds to a maximum flow area of the suction valve 214.

In some implementations, the controller 244 may cause a suction valve 214 to be maintained in an open position during a discharge cycle of the fluid pump 201 and during a suction cycle of the fluid pump 201. Alternatively, the controller 244 may cause a suction valve 214 to be maintained in an open position during a discharge cycle of the fluid pump 201, but may allow the suction valve 214 to operate normally during a suction cycle of the fluid pump 201 (e.g., the controller 244 may cause the suction valve 214 not to be maintained in the open position during the suction cycle). In some implementations, the controller 244 may cause the suction valves 214 to be maintained in their open positions sequentially in accordance with respective suction and discharge cycle timings of the fluid pump 201 (e.g., the cylinders of the fluid pump 201 may have different suction and discharge cycle timings to maintain a steady flow from the fluid pump 201). For example, upon the pump deactivating event, the controller 244 may cause a first suction valve 214, that is associated with a first discharge cycle following the pump deactivating event, to be maintained in an open position, then sequentially cause (e.g., after a time delay between a start of the first discharge cycle and a start of a second discharge cycle) a second suction valve 214, that is associated with a second discharge cycle following the pump deactivating event, to be maintained in an open position, and so forth. Alternatively, upon the pump deactivating event, the controller 244 may cause one or more first suction valves 214, that are open (e.g., during a suction cycle), to be maintained in open positions, and also cause one or more second suction valves 214, that are closed (e.g., during a discharge cycle), to be forced into open positions.

The controller 244 may issue activation signals to the valve control components 242 (e.g., to solenoid valves of the valve control components 242) to cause the valve control components 242 to maintain the suction valves 214 in open positions. In some examples, to cause the valve control components 242 to maintain the suction valves in open positions, the controller 244 may cause actuation of the valve control components 242 (e.g., plunger-type actuators) to extended positions such that the valve control components 242 hold open respective suction valves 214 (e.g., by contacting, or pushing against, the undersides of respective suction valves 214, or based on attachment of the valve control components 242 to the respective suction valves 214).

By activating the valve control components 242, the suction valves 214, that would otherwise close during discharge cycles of the fluid pump 201, are restricted from closing during the discharge cycles by the valve control components 242. As a result, a discharge stroke of a plunger 220 into a fluid chamber 208 will result in fluid being pumped through an open suction valve 214 back out into the suction manifold 218, rather than pressurizing the fluid sufficiently to open a discharge valve 216 of the fluid chamber 208. In this way, the fluid pump 201 may be rapidly unloaded from the prime mover 229 to quickly terminate discharge flow from the fluid pump 201. "Discharge cycle" may refer to a discharge stroke of the plunger 220, regardless of whether the discharge stroke discharges fluid from the fluid pump 201.

As indicated above, FIG. 3 is provided as an example. Other examples may differ from what is described with regard to FIG. 3.

Figure 4:
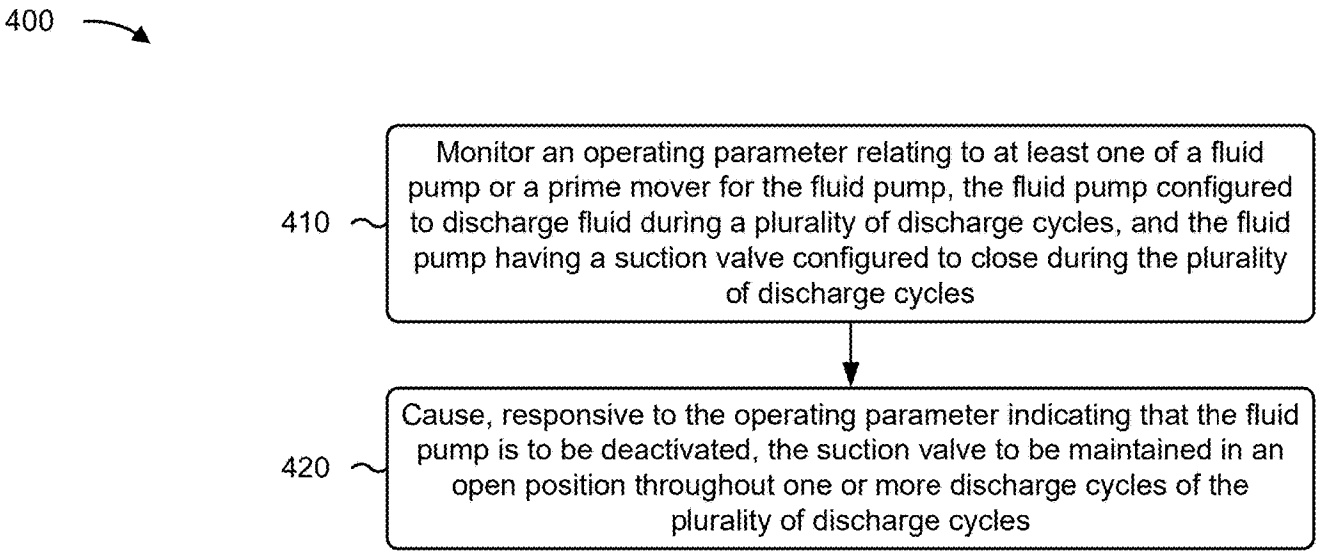
FIG. 4 is a flowchart of an example process associated with controlling suction valves of a fluid pump.

FIG. 4 is a flowchart of an example process 400 associated with controlling suction valves of a fluid pump. One or more process blocks of FIG. 4 may be performed by a controller (e.g., controller 244). Additionally, or alternatively, one or more process blocks of FIG. 4 may be performed by another device or a group of devices separate from or including the controller, such as another device or component that is internal or external to the fluid pump.

As shown in FIG. 4, process 400 may include monitoring an operating parameter relating to at least one of a fluid pump or a prime mover for the fluid pump, the fluid pump configured to discharge fluid during a plurality of discharge cycles, and the fluid pump having a suction valve configured to close during the plurality of discharge cycles (block 410). For example, the controller (e.g., using a memory, a processor, and/or a communication component) may monitor an operating parameter relating to at least one of a fluid pump or a prime mover for the fluid pump, as described above.

As further shown in FIG. 4, process 400 may include causing, responsive to the operating parameter indicating that the fluid pump is to be deactivated, the suction valve to be maintained in an open position throughout one or more discharge cycles of the plurality of discharge cycles (block 420). For example, the controller (e.g., using a memory, a processor, and/or a communication component) may cause, responsive to the operating parameter indicating that the fluid pump is to be deactivated, the suction valve to be maintained in an open position throughout one or more discharge cycles of the plurality of discharge cycles, as described above. The open position may correspond to an opening of the suction valve during a plurality of suction cycles of the fluid pump.

In some implementations, the operating parameter satisfying a threshold indicates that the fluid pump is to be deactivated. The operating parameter may be a discharge pressure of the fluid pump or a flow rate of the fluid pump. Additionally, or alternatively, the operating parameter may be a torque of the prime mover or a speed of the prime mover.

The suction valve may be maintained in the open position throughout the one or more discharge cycles while the prime mover is in a non-stationary state. The suction valve may be maintained in the open position throughout the one or more discharge cycles to cause termination of discharge flow from the fluid pump.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

The suction valve control system 240 described herein may be used with any fluid pump that employs a suction valve configured to open by differential pressure of fluid. For example, the suction valve control system 240 may be used with a positive displacement pump, such as a reciprocating pump. In particular, the suction valve control system 240 may be employed in a fluid pump used in an application relating to oil and gas extraction, such as hydraulic fracturing, well cementing, and/or well drilling, among other examples. For example, a fluid pump that uses the suction valve control system 240 may be a hydraulic fracturing pump, a cement pump, a mud pump, or an injection pump, among other examples. In general, a prime mover for a fluid pump may take a relatively long time to slow down from a non-stationary state, which may frustrate an attempt to rapidly terminate discharge flow from the fluid pump. For example, discharge flow from the fluid pump may need to be rapidly terminated in response to conditions that could cause damage to the pump or other equipment, as well as cause other adverse consequences.

The suction valve control system 240 described herein enables manipulation of the ordinary (e.g., differential-pressure-based) closing of suction valves of a fluid pump. For example, rather than allowing the suction valves to close naturally at the start of a discharge cycle of the fluid pump, the suction valve control system 240 may hold open the suction valves throughout the discharge cycle. While the suction valves are held open, fluid is pumped through the open suction valves back out into a suction manifold, rather than being pressurized sufficiently to exit through discharge valves of the fluid pump.

Accordingly, by holding open the suction valves, the fluid pump may be rapidly unloaded from a prime mover to quickly terminate discharge flow from the fluid pump, thereby facilitating quick response to hazardous conditions such as sand off conditions or other overpressure conditions. Moreover, the fluid pump can be driven by a prime mover operating at a constant speed and/or without use of a transmission (e.g., disengagement of the fluid pump from the prime mover through a "quick to neutral" operation of the transmission is not needed to quickly terminate discharge flow from the fluid pump 201), thereby simplifying and reducing a size and weight of a pump system.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

When "a processor" or "one or more processors" (or another device or component, such as "a controller" or "one or more controllers") is described or claimed (within a single claim or across multiple claims) as performing multiple operations or being configured to perform multiple operations, this language is intended to broadly cover a variety of processor architectures and environments. For example, unless explicitly claimed otherwise (e.g., via the use of "first processor" and "second processor" or other language that differentiates processors in the claims), this language is intended to cover a single processor performing or being configured to perform all of the operations, a group of processors collectively performing or being configured to perform all of the operations, a first processor performing or being configured to perform a first operation and a second processor performing or being configured to perform a second operation, or any combination of processors performing or being configured to perform the operations. For example, when a claim has the form "one or more processors configured to: perform X; perform Y; and perform Z," that claim should be interpreted to mean "one or more processors configured to perform X; one or more (possibly different) processors configured to perform Y; and one or more (also possibly different) processors configured to perform Z."

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A suction valve control system of a fluid pump that is driven by a reciprocating engine without use of a transmission and configured to discharge fluid during a plurality of discharge cycles, the suction valve control system comprising:

a plurality of suction valves, of the fluid pump, that are configured to close during the plurality of discharge cycles, wherein the plurality of suction valves include all suction valves of the fluid pump; and a controller configured to:

cause, responsive to a pump deactivating event and to deactivate the fluid pump, the plurality of suction valves to be maintained in an open position throughout one or more discharge cycles of the plurality of discharge cycles, wherein the open position corresponds to an opening of the plurality of suction valves during a plurality of suction cycles of the fluid pump;

receive, from an additional controller of the reciprocating engine, a measurement indicating that the reciprocating engine is in a stationary state; and release, based on the measurement indicating that the reciprocating engine is in the stationary state, the plurality of suction valves from being maintained in the open position.

2. The suction valve control system of claim 1, wherein the controller is further configured to:

cause, during one or more prior discharge cycles of the plurality of discharge cycles prior to the pump deactivating event, the plurality of suction valves not to be maintained in the open position during any portion of the one or more prior discharge cycles.

3. The suction valve control system of claim 1, wherein the controller is further configured to:

receive an indication, based on a user input, that the fluid pump is to be deactivated, wherein receiving the indication is the pump deactivating event.

4. The suction valve control system of claim 1, wherein the controller is further configured to:

monitor a discharge pressure or a flow rate of the fluid pump; and detect that the discharge pressure or the flow rate satisfies a threshold, wherein detecting that the discharge pressure or the flow rate satisfies the threshold is the pump deactivating event.

5. The suction valve control system of claim 1, wherein the open position is a full open position that corresponds to a maximum flow area of the plurality of suction valves.

6. The suction valve control system of claim 1, further comprising a plurality of valve control components configured to control actuation of the plurality of suction valves.

7. The suction valve control system of claim 6, wherein the controller, to cause the plurality of suction valves to be maintained in the open position, is configured to:

cause the plurality of valve control components to maintain the plurality of suction valves in the open position.

8. The suction valve control system of claim 7, wherein the controller, to cause the plurality of valve control components to maintain the plurality of suction valves in the open position, is configured to:

cause actuation of the plurality of valve control components to an extended position to hold open the plurality of suction valves.

9. The suction valve control system of claim 1, wherein the plurality of suction valves are to be maintained in the open position throughout the one or more discharge cycles while the reciprocating engine is in a non-stationary state.

10. The suction valve control system of claim 1, wherein the plurality of suction valves are to be maintained in the open position throughout the one or more discharge cycles to cause termination of all discharge flow from the fluid pump.

11. A method, comprising:

monitoring, by a controller, a discharge pressure or a flow rate of a fluid pump, the fluid pump driven by a reciprocating engine without use of a transmission and configured to discharge fluid during a plurality of discharge cycles, and the fluid pump having a plurality of suction valves configured to close during the plurality of discharge cycles wherein the plurality of suction valves include all suction valves of the fluid pump;

causing, by the controller and responsive to the discharge pressure or the flow rate indicating that the fluid pump is to be deactivated, the plurality of suction valves to be maintained in an open position throughout one or more discharge cycles of the plurality of discharge cycles;

receiving, by the controller from an additional controller of the reciprocating engine, a measurement indicating that the reciprocating engine is in a stationary state; and releasing, by the controller and based on the measurement indicating that the reciprocating engine is in the stationary state, the plurality of suction valves from being maintained in the open position.

12. The method of claim 11, wherein the open position corresponds to an opening of the plurality of suction valves during a plurality of suction cycles of the fluid pump.

13. The method of claim 11, wherein the discharge pressure or the flow rate satisfying a threshold indicates that the fluid pump is to be deactivated.

14. The method of claim 11, wherein the plurality of suction valves are to be maintained in the open position throughout the one or more discharge cycles while the reciprocating engine is in a non-stationary state.

15. The method of claim 11, wherein the plurality of suction valves are to be maintained in the open position throughout the one or more discharge cycles to cause termination of all discharge flow from the fluid pump.

16. A fluid pump system, comprising:

a fluid pump, comprising:

a fluid end having a fluid chamber, a plunger configured to reciprocate with respect to the fluid chamber, and a plurality of suction valves biased to a closed position with respect to the fluid chamber; and a power end, operably connected to the plunger, configured to be driven by a reciprocating engine without use of a transmission; and a suction valve control system, comprising:

a plurality of valve control components configured to control actuation of the plurality of suction valves; and a controller, communicatively coupled to the plurality of valve control components, configured to:

cause the plurality of valve control components to maintain the plurality of suction valves in an open position throughout one or more discharge cycles of the fluid pump to cause termination of all discharge flow from the fluid pump;

receive, from an additional controller of the reciprocating engine, a measurement indicating that the reciprocating engine is in a stationary state; and release, based on the measurement indicating that the reciprocating engine is in the stationary state, the plurality of suction valves from being maintained in the open position.

17. The fluid pump system of claim 16, wherein the open position is a full open position that corresponds to a maximum flow area of the plurality of suction valves.

18. The fluid pump system of claim 16, wherein the controller, to cause the plurality of valve control components to maintain the plurality of suction valves in the open position, is configured to:

cause actuation of the plurality of valve control components to an extended position to hold open the plurality of suction valves.

19. The fluid pump system of claim 16, wherein the controller, to cause the plurality of valve control components to maintain the plurality of suction valves in the open position, is configured to:

cause the plurality of valve control components to maintain the plurality of suction valves in the open position until the reciprocating engine is in the stationary state.

20. The fluid pump system of claim 16, wherein the controller is further configured to:

monitor a discharge pressure or a flow rate of the fluid pump; and detect that the discharge pressure or the flow rate satisfies a threshold, wherein the controller is configured to cause the plurality of valve control components to maintain the plurality of suction valves in the open position responsive to the discharge pressure or the flow rate indicating that the fluid pump is to be deactivated.

* * * * *